US005765294A

United States Patent [19]

Puschnerat

[11] Patent Number: 5,765,294

[45] Date of Patent: Jun. 16, 1998

[54] METHOD AND APPARATUS FOR FEEDING AND DRYING A PRINTED PAPER WEB

[75] Inventor: Helmut Puschnerat, Wachenheim, Germany

[73] Assignee: Koenig & Bauer-Albert Aktiengesellschaft, Wurzburg, Germany

[21] Appl. No.: 764,281

[22] Filed: Dec. 12, 1996

[30] Foreign Application Priority Data

Dec. 12, 1995 [DE] Germany ..... 195 46 265.3

[51] Int. Cl.[6] ..... F26B 7/00

[52] U.S. Cl. ..... 34/381; 34/421; 34/461; 34/464; 101/424.1; 101/488; 101/226

[58] Field of Search ..... 34/359, 360, 363, 34/367, 371, 380, 381, 421, 422, 444, 451, 459, 460, 461, 464; 101/424.1, 488, 226; 225/3, 106

[56] References Cited

U.S. PATENT DOCUMENTS

| | | | |
|---|---|---|---|
| 2,731,732 | 1/1956 | Harris, Jr. et al. | 34/422 |
| 4,567,673 | 2/1986 | Böhnensieker | 34/422 X |
| 5,043,749 | 8/1991 | Punater et al. | 346/153.1 |
| 5,060,572 | 10/1991 | Waizmann | 34/444 X |
| 5,458,062 | 10/1995 | Goldberg et al. | 101/226 X |
| 5,537,925 | 7/1996 | Secor et al. | 101/424.1 |
| 5,606,914 | 3/1997 | Borgardt | 101/488 |
| 5,642,671 | 7/1997 | Winheim | 34/451 X |

FOREIGN PATENT DOCUMENTS

| | | |
|---|---|---|
| 1 201 256 | 9/1965 | Germany . |
| 24 60 612 | 8/1984 | Germany . |
| 405216218 | 8/1993 | Japan . |
| 408127119 | 5/1996 | Japan . |
| 2258191 | 2/1993 | United Kingdom . |

*Primary Examiner*—Henry A. Bennett
*Assistant Examiner*—Steve Gravini
*Attorney, Agent, or Firm*—Jones, Tuller & Cooper, P.C.

[57] ABSTRACT

A wide printed paper web is longitudinally separated into at least two partial paper webs after the last printing unit of a printing press and before being dried. The plural partial paper webs are dried in a drying device on separate or the same level. The partial paper webs are dried in a smudge-free manner and are free of longitudinal creases or folds.

4 Claims, 1 Drawing Sheet

METHOD AND APPARATUS FOR FEEDING AND DRYING A PRINTED PAPER WEB

FIELD OF THE INVENTION

The present invention is directed generally to a method and apparatus for feeding and drying a printed paper web. More particularly, the present invention is directed to a method and apparatus for feeding and drying a wide printed paper web. Most specifically, the present invention is directed to a method and apparatus for feeding and drying a wide printed paper web in which the wide printed paper web is divided longitudinally after a final printing unit and prior to entry into a drying device. The longitudinally separated printed paper web will be guided into two drying ovens or sections of a drying device if the web is divided into two sections. The drying ovens or sections can be arranged in two separate levels, or on the same level. The two partial printed paper webs can run parallel to each other or can be made to diverge in the drying oven of the drying device.

DESCRIPTION OF THE PRIOR ART

A continuous paper web is typically printed by passing through a plurality of printing units arranged in a rotary web fed printing press. The printed paper web is then typically fed into a dryer prior to its being longitudinally formed, cross cut and folded into printed web segments. The demand for faster printing presses and for higher production speeds has led to the use of increasingly wide paper webs and to the provision of wider presses that can handle these wide paper webs. One problem which has arisen with the use of such wide paper webs and presses is the creation of longitudinal folds in the printed web. These longitudinal folds are created in the course of the continuous drying of the wide printed paper web in, for example, a hot air dryer. These longitudinal folds have an adverse effect on the quality of the printed paper product and their existence in the product is cause for the discarding of the product.

It will be seen that a need exists for a procedure and for a device which will facilitate the feeding of a wide printed paper web into a drying device that will avoid the formation of longitudinal folds and creases, and which will accomplish the drying of the printed paper web in a smudge-free manner. The method and apparatus for feeding and drying a printed paper web in accordance with the present invention provides such a device and is a significant advance over the prior art.

SUMMARY OF THE INVENTION

It is an object of the present invention to provide a method and an apparatus for feeding and drying a printed paper web.

Another object of the present invention is to provide a method and an apparatus for feeding and drying a wide printed paper web.

A further object of the present invention is to provide a method and an apparatus for feeding and drying a wide printed paper web which is separated longitudinally after printing and before drying.

Still another object of the present invention is to provide a method and an apparatus for feeding and drying a wide printed paper web utilizing two drying ovens at separate levels.

Yet a further object of the present invention is to provide a method and an apparatus for drying a wide printed paper web in a manner which results in a web that is nearly free of longitudinal creases or waves.

As will be discussed in detail in the description of the preferred embodiments, which is set forth subsequently, a wide printed paper web is divided longitudinally into two or more partial paper web segments after it exits the last printing unit in a typical web-fed rotary printing device. The longitudinally severed partial paper webs are then directed into several drying sections or ovens which together constitute a printed paper web drying device. Each drying section or oven acts on its partial printed paper web segment. The drying sections or ovens can be arranged at different height levels, or can be at the same level. The partial paper webs can pass through the drying ovens in parallel paths or can be caused to separate or diverge slightly from each other as they pass through their individual drying ovens. If the drying sections or ovens are of the "contactless" type, the printed paper web segments can be dried in a smudge-free manner while avoiding the creation of longitudinal creases.

A particular advantage of the method and apparatus for feeding and drying printed paper webs in accordance with the present invention is that the formation of longitudinal folds, creases, or so-called waves can be prevented in connection with the drying of extra wide printed paper webs; i.e. paper webs having a width starting, for example, at approximately one meter. The elimination of these creases or waves results in an increased printing press productivity and a higher printing efficiency rate.

The wide printed paper web is separated longitudinally and can then be fed into two separate dryers in the drying device. The use of two separate dryers, each of standard design, helps keep equipment and operating costs down. The two separate dryers can be located at different heights in a configuration that provides easy access. Since each of the separate dryers is of standard width and since the several dryers are placed at different levels, they can be accessed and maintained by plant personnel in an advantageous manner.

The method and apparatus for feeding and drying a printed paper web in accordance with the present invention overcomes the limitations of the prior art. It is a substantial advance in the art.

BRIEF DESCRIPTION OF THE DRAWINGS

While the novel features of the method and apparatus for feeding and drying a printed paper web in accordance with the present invention are set forth with particularity in the appended claims, a full and complete understanding of the invention may be had by referring to the detailed description of the preferred embodiments, which is presented subsequently, and as illustrated in the accompanying drawings, in which:

DETAILED DESCRIPTION OF THE PREFERRED EMBODIMENTS

Figure 1:
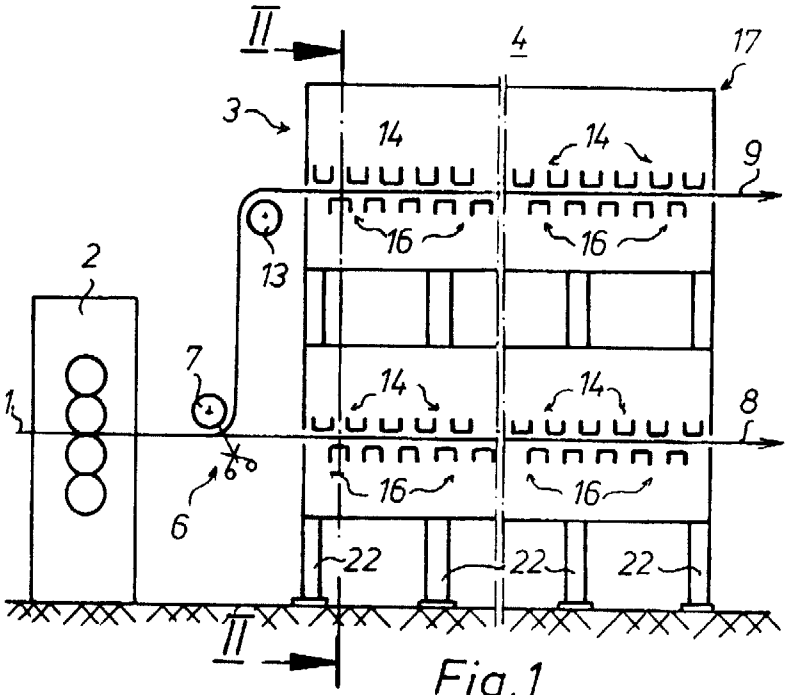
FIG. 1 is a longitudinal sectional view through a schematic representation of a device in accordance with the present invention for accomplishing the longitudinal separation and drying of a printed paper web.

Referring initially primarily to FIG. 1, there may be seen a device for feeding and drying a wide printed paper web 1 in is accordance with the present invention. The wide printed paper web 1 is printed as it passes through one or more printing units in a rotary web-fed printing press. Since the printing press is generally conventional in structure and operation, it is not depicted in the drawings. The wide printed paper web 1 passes through printing unit 2, which may be the last or final printing unit in the rotary, web-fed press, and is cut longitudinally by a longitudinal cutting device 6. This longitudinal cutting device is positioned after the last print unit 2 and before the beginning 3 of a drying device 4 which may be, for example, a hot air dryer. The longitudinal cutting device 6 can include a paper guide roller 7 which can, for example, support a circular cutter. The cutting device 6 longitudinally separates the wide, printed paper web 1, which may, for example have a web width of 160 cm, along a longitudinal center line into two partial paper webs 8 and 9 which each have a partial web width of 80 cm; i.e. the cutting device 6 can cut or divide the wide paper web 1 longitudinally into two equal width partial paper webs-8 and 9.

Figure 2:
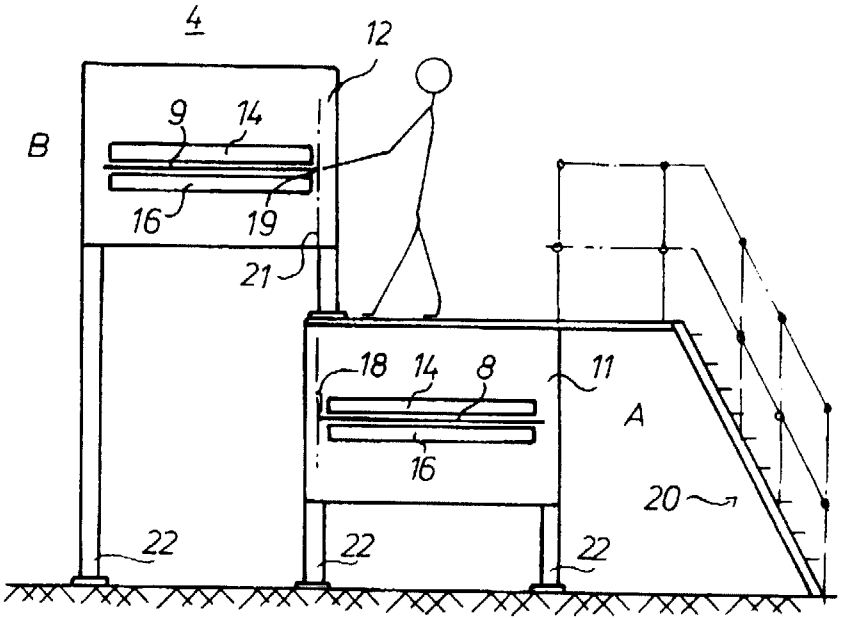
FIG. 2 is a transverse sectional view of the device depicted in FIG. 1 and taken along line II—II of FIG. 1 and showing the two drying ovens at different height levels.

As may be seen in FIGS. 1 and 2, the first partial paper web 8 is directed into a first or lower drying oven 11 of the drying device 4. This lower drying oven 11 is situated on a lower level A, as may be seen most clearly in FIG. 2. The second partial paper web 9 is led over an upper paper guide roller 13 into a second or upper drying oven 12 of the drying device 4. This upper drying oven 12 is located on an upper level B. Each of the partial paper webs 8 and 9 are dried in the drying sections of their respective drying ovens 11 and 12. These two drying ovens 11 and 12 may be hot air dryers that each utilize upper and lower hot air nozzles 14 and 16. These upper and lower hot air nozzles 14 and 16 are disposed above and below each of the partial paper webs 8 and 9 in both of the drying ovens 11 and 12, as shown in both FIGS. 1 and 2. The partial paper webs B and 9 are supported in the drying ovens 11 and 12 in a contact free manner so that any printing on the partial paper webs will not be smudged. Air may also be directed out of the paper guide rollers 7 and 13 to insure contactless guidance of the partial paper webs 8 and 9. The partial paper webs 8 and 9 exit their respective drying ovens 11 and 12 of the drying device 4 at the exit end 17 of the device 4 and are then fed to suitable coolers.

In the first preferred embodiment of the subject invention, the two drying ovens 11 and 12 are disposed at lower and upper levels A and B, respectively, as seen in FIGS. I and 2, and are also situated laterally offset from each other, as shown in FIG. 2. The lateral offset of the two drying ovens 11 and 12 is such that inner lateral edges 18 and 19 of the two partial paper webs 8 and 9 are aligned above each other and in abutment with an imaginary perpendicular plane 21, as depicted in FIG. 2. Each one of the drying ovens 11, and 12 is supported in a suitable framework, generally at 22, and, the top of the lower drying oven 11 is structured so that it can be accessed using a Bet of stairs 20. This upper surface of the lower drying oven 11 thereby acts as a platform which affords easy access to the upper drying oven 12. A maintenance worker can easily maintain the upper drying oven 12 from the platform top of the lower drying oven 11. Instead of the two essentially separate drying ovens 11 and 12 depicted in FIG. 2, the two partial paper webs 8 and 9 could be dried in a drying device 4 that consists of a single drying oven having two drying sections at levels A and B. The lateral inner edges 18 and 19 of the two partial paper webs 8 and 9 would still be situated above each other and would still abut the imaginary perpendicular plane 21.

Figure 3:
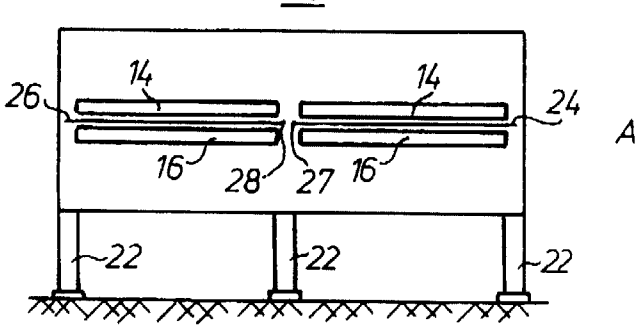
FIG. 3 is a transverse sectional view of a second preferred embodiment of the present invention and showing the two drying ovens at the same height.

In a second preferred embodiment of the device for feeding and drying a printed paper web in accordance with the present invention, as depicted in FIG. 3, the wide printed paper web 1 will again be longitudinally separated at its center by use of the longitudinal cutting device 6. In this second embodiment, the two partial paper webs 24 and 26 are fed to the drying section of a drying device 23 in a side by side manner. Both of the partial paper webs 24 and 26 are maintained at the same lower level A. In this second preferred embodiment, the newly created inner lateral edges 27 and 28 of the partial paper webs 24 and 26, that are formed following the longitudinal separating cut, extend parallel to each other through their passage through the single drying device 23, as depicted in FIG. 3.

Figure 4:
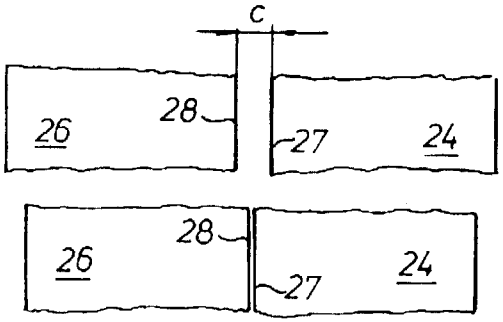
FIG. 4 is a top plan view of the partial printed paper webs guided at the beginning and at the end of the drying devices depicted generally at FIG. 3, and showing a third preferred embodiment of the present invention.

In a third preferred embodiment, which is depicted schematically in FIG. 4, the partial paper webs 24 and 26 move through a drying device, in a manner analogous to the device 4, from the beginning 3 to the end 17 of the drying device 23 in such a way that the inner lateral edges 24 and 26 of the partial paper webs 24 and 26 move apart from each other. As depicted in FIG. 4, after the partial paper webs 24 and 26 are formed by the longitudinal cutting device 6 from the wide paper web 1, they will be separated laterally as they move through the drying device 23. A partial web separation distance "c", will be generated at the exit end 17 of the drying device 23. This partial web separation distance "c" can be between five to fifty millimeters.

In the present invention, the formation of longitudinal folds or creases in the paper web is prevented, during drying of the web, by the separation of the single wide printed web 1 into the plurality of partial paper webs 8 and 9 or 24 and 26. The partial paper webs 8 and 9 or 24 and 26 are fed into the respective drying devices 4 or 23 after being longitudinally separated subsequent to the passage of the wide paper web 1 through the last print unit 2. Regardless of whether the partial webs 8 and 9 or 24 and 26 are dried at two distinct levels A and B, or at only one level A, the drying occurs after the printed web has been separated.

In accordance with the present invention, it would also be possible to dry even wider printed paper webs in a manner that renders the webs free of longitudinal creases- This would be accomplished by separating the printed paper web into thirds by using two cutting devices instead of one. The wide printed paper web would thus be longitudinally divided into thirds prior to its entry into either one common or three separately arranged drying ovens. The three separately arranged drying ovens could be situated at the same level or alternatively could be situated at three different levels.

While preferred embodiments of a method and apparatus for feeding and drying a printed paper web in accordance with the present invention have been set forth fully and completely hereinabove, it will be apparent to one of skill in the art that a number of changes in, for example, the type of printing press used, the type of printing being accomplished, the drive of the press and the like could be made without departing from the true spirit and scope of the present invention which is accordingly to be limited only by the following claims.

What is claimed is:

1. A method for feeding and drying a printed paper web including:

printing a paper web in a printing press including a last printing unit;

separating said printed paper web longitudinally in a direction of paper web travel into a plurality of printed partial paper webs after passage of said printed paper web through said last printing unit of said printing press;

providing a paper web drying device after, in said direction of paper web travel said printing unit;

configuring said paper web drying device having a plurality of printed partial paper web drying sections; and feeding each one of said printed partial paper webs to a separate one of said plurality of printed partial paper web drying sections of said drying device after separating said printed paper web longitudinally into said plurality of printed partial paper webs.

2. The method of claim 1 further including feeding said printed partial paper webs to said paper web drying device on a single level.

3. The method of claim 1 further including separating said printed partial paper webs laterally following their longitudinal separation.

4. The method of claim 1 further including providing said drying device having said plurality of printed partial paper web drying sections on levels of separate heights and feeding said longitudinally separated printed partial paper webs to said separate levels of said drying device.

* * * * *